US005839840A

United States Patent [19]

Kawano

[11] Patent Number: 5,839,840

[45] Date of Patent: Nov. 24, 1998

[54] TAPE PRINTING APPARATUS

[75] Inventor: Isao Kawano, Nagoya, Japan

[73] Assignee: Brother Kogyo Kabushiki Kaisha, Nagoya, Japan

[21] Appl. No.: 935,672

[22] Filed: Sep. 23, 1997

[30] Foreign Application Priority Data

Sep. 26, 1996 [JP] Japan ..... 8-254280

[51] Int. Cl.[6] ..... B41J 11/00

[52] U.S. Cl. ..... 400/621; 400/593; 101/226

[58] Field of Search ..... 101/226; 400/621, 400/621.1, 621.2, 593

[56] References Cited

U.S. PATENT DOCUMENTS

| | | | |
|---|---|---|---|
| 4,927,278 | 5/1990 | Kuzuya et al. | 400/208 |
| 5,188,469 | 2/1993 | Nagao et al. | 400/615.2 |
| 5,224,786 | 7/1993 | Takagi et al. | 400/621 |
| 5,259,681 | 11/1993 | Kitazawa et al. | 400/621 |
| 5,441,352 | 8/1995 | Shiota | 400/621 |

FOREIGN PATENT DOCUMENTS

| | | |
|---|---|---|
| U 3-6966 | 1/1991 | Japan . |
| A 7-52479 | 2/1995 | Japan . |

*Primary Examiner*—Edgar S. Burr
*Assistant Examiner*—Dave E. Ghatt
*Attorney, Agent, or Firm*—Oliff & Berridge, PLC

[57] ABSTRACT

A platen holder 8 is provided with a stopper member 12 which comes into contact with a lever 20 depressed when the platen holder 8 is rotated to a home position by removing of a cassette cover 2B from an upper cover 2A. The stopper member 12 is formed to have a contact plane 12A so that an angle α defined between the contact plane 12A and an imaginary line connecting a tip end R of the stopper member 12 and a fixed point P is set to approximately 90° or less than 90°. A projection part 13 is provided in the platen holder 8, which is to be pressed by a tape cassette 4 when inserted in a tape receiving part. When the platen holder 8 is rotated to an operational position after the cassette cover 2B is attached to the upper cover 2A, a clearance is produced between the projection part 13 of the platen holder 8 and the tape cassette 4.

13 Claims, 10 Drawing Sheets

TAPE PRINTING APPARATUS

BACKGROUND OF THE INVENTION

1. Field of the Invention

The present invention relates to a tape printing apparatus provided with a blade for cutting a printed part of tape, the blade being moved by interlocking with a lever, more particularly to a tape printing apparatus capable of preventing any danger by the blade interlocking with the lever.

2. Description of Related Art

Tape printing apparatuses which print characters and the like on a print medium such as a tape are conventionally provided with a cutting mechanism to cut the tape with a blade and the like. For example, a tape printing apparatus 1 having a main body 2 shown in FIG. 4 is provided with a lever 20 which is operated to interlock with a blade disposed in the main body 2. When this lever 20 is depressed, a tape 3 discharged from the main body 2 is cut with the blade.

Such the cutting mechanism of the tape printing apparatus 1 (referred to as merely "cutting structure" hereinafter) will be explained below in connection with inserting operation of a tape cassette 4 (see FIG. 5) and depressing operation of the lever 20. The main body 2 of the tape printing apparatus 1 shown in FIG. 4 is constructed of an upper cover 2A, a cassette cover 2B which is a first lower cover (see FIG. 6) and a second lower cover 2C (see FIG. 5). Note that the side of the tape printing apparatus 1 shown in FIG. 4 is an upper face.

First, the tape printing apparatus shown in FIG. 4 is turned over, to remove the cassette cover 2B from the upper cover 2A, thereby exposing a tape receiving part formed in the main body 2. Then, the tape cassette 4 is inserted in the tape receiving part. The tape receiving part and around it in this state are schematically shown in FIG. 5. As shown in FIG. 5, around the tape receiving part, there are provided a platen holder 8, a supporting plate 6 for supporting a thermal head 5, a position fixing member 7, a lever 20, and a holding member 30 for holding a blade 10 for cutting a tape fed out of the tape cassette 4.

The platen holder 8 is rotatable about a fixed point P and is always biased by a resilient member and the like not shown toward the position fixing member 7. The platen holder 8 is thus fixedly kept in a position where it is in contact with the fixing member 7 when the cassette cover 2B is removed from the upper cover 2A as shown in FIG. 5, the position being referred to as "home position" of the platen holder 8 hereinafter. As shown in FIG. 6, the cassette cover 2B is provided with an engaging portion 9 whereby the platen holder 8 is made to rotate toward the tape cassette 4 side. When the cassette cover 2B is attached to the upper cover 2A, the engaging portion 9 is inserted between the platen holder 8 and the position fixing member 7, thereby making the platen holder 8 rotate toward the tape cassette 4. As shown in FIG. 7, the engaging portion 9 is formed to have a slant tip end so as to be easily inserted between the platen holder 8 and the position fixing member 7.

With the engaging portion 9, the platen holder 8 is rotated toward the tape cassette 4 up to a position where a part of the tape 3 of the tape cassette 4 is pressed against the thermal head 5, and is fixedly supported at that position. This position is referred to as an "operational position" of the platen holder 8 hereinafter. During the platen holder 8 being positioned in the operational position, the rotation of a platen roller 8A causes the tape 3 to be fed from the tape cassette 4 and discharged out of the main body 2.

In this way, the platen holder 8 can be moved from the home position and the operational position or vice versa in accordance with the removing/attaching of the cassette cover 2B from/to the upper cover 2A. The platen holder 8 may also be moved by means of a structure of a printing apparatus, e.g., disclosed in Japanese Utility Application Laid-open No. 3-6966, in which a holder is moved between a release position (corresponding to the home position) and a printing position (corresponding to the operational position).

The cutting structure is mainly constructed of the lever 20 and the holding member 30. FIG. 8 is a perspective view of the lever 20 and FIG. 9 is a perspective exploded view of the holding member 30. As shown in FIG. 8, the lever 20 is provided with a boss 22 and a pressing member 21 for pressing a holding plate 32 (see FIG. 9) of the holding member 30. The lever 20 is formed to be hollow. As shown in FIG. 9, a boss portion 35 is formed in the holding member 30, which is coaxial with the boss 22 of the lever 20. A return spring 11 serving as a resilient member is attached with clearance around the boss portion 35, as shown in FIG. 5. The holding member 30 is further provided with a pair of upper and lower guide grooves 31, as shown in FIG. 9, in which the holding plate 32 mentioned later can be slid as upper and lower portions thereof are covered by wall portions 31A forming the guide grooves 31. A part of the holding plate 32 is exposed between the upper and lower guide grooves 31, so that the pressing member 21 of the lever 20 can come into contact with the rear end plane 37 of the holding plate 32 (the right end plane in the FIG. 9) to push the same.

The holding plate 32 is provided with a projection 33 and an engaging hole 34 and the like. When a round hole 10A of the blade 10 is fitted to the projection 33, the blade 10 is fixedly mounted on the holding plate 32. Since this holding plate 32 can be slid in the guide grooves 31 with its upper and lower portions covered by the wall portions 31A, the blade 10 can be slidably held in the holding member 30 covering almost the blade 10. In order to prevent the rotation of the blade 10 mounted on the holding member 32 about the projection 33, stopper portions 36 are formed on the holding plate 32.

The holding member 30 mentioned above is fixedly mounted in the upper cover 2A so as to make the guide grooves 31 open toward the tape cassette 4. The lever 20 is assembled with the upper cover 2A by inserting a supporting shaft 38 into the boss 22 of the lever 20 after inserting the same in the boss portion 35 of the holding member 30. Thus, the lever 20 can rotate about the supporting shaft 38 (the center point of rotation is referred to as "a rotating center Q" hereinafter). The return spring 11 mounted with clearance around the boss portion 35 of the holding member 30 is connected at one end thereof to the engaging hole 34 of the holding plate 32 and at another end to a part of the holding member 30. This makes the holding plate 32 be always biased backward in the holding member 30 (rightward in the drawing) by a biasing force of the return spring 11, whereby the blade 10 attached to the holding plate 32 is held in the holding member 30. The position of the blade 10 in this state is a holding position.

When the lever 20 is depressed, rotating clockwise in FIG. 2, the pressing member 21 of the lever 20 presses the part of the holding plate 32 positioned between the upper and lower guide grooves 31. The blade 10 attached to the holding plate 32 is thus moved along the guide grooves 31 toward the tape cassette 4. When the lever 20 is further depressed, the blade 10 protrudes out of the holding member 30 and comes into contact with a part of the tape cassette 4, when the tape 3 existing between the tape cassette 4 and the holding member 30 is cut out. The position of the blade 10 in this state is a cutting position.

Since the blade 10 is always biased backward in the holding member 30 as mentioned above, it is automatically returned into the holding member 30 when the depressing of the lever 20 is released. Accordingly, the blade 10 is normally held in the holding member 30 while the lever 20 is not operated, which can substantially prevent a user from touching the blade 10 by accident.

However, in the tape printing apparatus 1 mentioned above, the lever 20 can be depressed in spite of the attaching and removing of the cassette cover 20B. The blade 10 is thus made to protrude out of the holding member 30 by the operation of the lever 20 even when the cassette cover 2B is removed from the upper cover 2A, which allows an user to easily touch the blade 10 if any tape cassette 5 is not set in the tape receiving part, as shown in FIGS. 10 and 11, thereby causing the danger of damaging the user.

To resolve the above problem, a blade protecting apparatus disclosed in Japanese Patent Application Laid-open No. 7-52479 may be used. In this blade protecting apparatus, specifically, a blade is prevented from moving by a blade protecting member positioned in a first position and is allowed to move by the blade protecting member moved to a second position when an appropriate cassette is inserted, thus achieving the safe operation of the blade. However, such the blade protecting apparatus needs an installation pace in the tape printing apparatus 1, which is not desirable in design of the tape printing apparatus 1, and also causes the increase in the number of components forming the tape printing apparatus 1, which is not desirable in manufacture thereof. Furthermore, the blade protecting apparatus is constructed so as to prevent the movement of the blade by engaging with the tip of the blade, thereby causing the damage to the tip of the blade, resulting in a lowered cutting power of the blade and a shortened life of the same.

On the other hand, if improvements can be made on existing components of the tape printing apparatus 1 to avoid the danger by the blade 10 moved by interlocking with the lever 20, it is greatly effective in design and manufacture of the tape printing apparatus because no space is needed and the number of components is not increased.

SUMMARY OF THE INVENTION

The present invention has been made in view of the above circumstances and has an object to overcome the above problems and to provide a tape printing apparatus capable of preventing the danger by a blade which is to be moved with the operation of a lever by making improvements on existing parts of the apparatus, without needing an additional space, increasing the number of parts, and also damaging the blade.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a tape printing apparatus of this invention comprises a main body having a tape receiving part, a cover member for opening and closing the tape receiving part, a tape cassette having a print tape therein, the tape cassette being set in the tape receiving part, a platen mechanism movable between an operational position and a home position according to a closing and opening operation of the cover member, the platen mechanism feeding the tape from the tape cassette, a print head for printing on the print tape fed by the platen mechanism, a blade for cutting the print tape after printed by the print head, a holding member for covering the blade slidably therein between a cutting position and a holding position, a resilient member for biasing the blade toward the holding position, a lever for pressing the blade toward the cutting position, and a stopper member formed on the platen mechanism, which comes into contact with the lever when the platen mechanism is in the home position according to opening of the cover member and sets a lock mode that the blade is held in the holding position.

According to the tape printing apparatus constructed as above, when the cassette cover is closed, moving the platen mechanism to an operational position, the blade can be protruded out of the holding member in cooperation with the movement of the lever and can cut a tape fed by the platen mechanism. On the other hand, when the cassette cover is opened, moving the platen mechanism to a home position, the lever comes into contact with the stopper member and the lever is prevented from moving to make the blade protrude out of the holding member. At this time, the blade can also be held in the holding member because it is biased backward in the holding member by a resilient member.

More specifically, the opening of the cassette cover sets the apparatus in a lock mode. In this lock mode, the blade is not protruded out of the holding member even if the lever is operated by accident. This makes it possible to prevent the danger of damaging an user by the blade even if the user touches the holding member in the tape printing apparatus as the cassette cover is opened.

If only providing the stopper member to an existing platen mechanism, the tape printing apparatus can be set in the lock mode by opening and closing operations of the cassette cover, so that the danger by the blade moved according to the operation of the lever, without needing an additional space and increasing the number of parts. Since the blade is biased backward in the holding member by a resilient member, the holding member can hold the blade without coming into contact with the tip end of the blade. This can prevent the tip end of the blade from being damaged, he cutting power of same from being lowered, and the life of same from being shortened.

According to another aspect of the present invention there is provided a tape printing apparatus comprising a main body having a tape receiving part, a tape cassette removably inserted in the tape receiving part, the tape cassette holding a tape therein, a printing means for performing a print operation on the tape fed out of the tape cassette, a blade for cutting the tape printed by the printing means, the blade being movable between a cutting position and a holding position apart from the tape, a lever to be operated for moving the blade from the holding position to the cutting position, and a stopper member for preventing the lever from being operated to move the blade from the holding position to the cutting position when the tape cassette is removed from the tape receiving part and, alternatively, for allowing the lever to be operated when the tape cassette is inserted in the tape receiving part.

In the tape printing apparatus constructed as above, when the tape cassette is set in the tape receiving part, allowing the operation of the lever, the blade can be moved from the holding position to the cutting position, so that the tape on which desired images are printed by the printing means can be cut out with the blade. On the other hand, when the tape cassette is removed from the tape receiving part, restricting the operation of the lever, the blade can not be moved from the holding position to the cutting position.

More specifically, while the tape cassette is removed from the tape receiving part, the blade is not allowed to move from the holding position to the cutting position even if the lever is operated by mistake. Thus, there is no danger of damaging an user by the blade when the tape cassette is removed from the tape receiving part. The holding member can hold the blade in the holding position without coming into contact with the tip end of the blade. As a result thereof, the tip end of the blade is not damaged, thus not reducing the cutting force of the blade and not shortening the life of same.

According to another aspect of the present invention there is provided a tape printing apparatus comprising a main body having a tape receiving part, a tape cassette removably inserted in the tape receiving part, the tape cassette holding a tape therein, a cassette cover for covering the tape receiving part, removably attached to the tape receiving part, a printing means for performing a print operation on the tape fed out of the tape cassette, a blade for cutting the tape printed by the printing means, the blade being movable between a cutting position and a holding position apart from the tape, a lever to be operated for moving the blade from the holding position to the cutting position, and a stopper member for preventing the lever from being operated to move the blade from the holding position to the cutting position when the cassette cover is removed from the tape receiving part and, alternatively, for allowing the lever to be operated when the cassette cover is set to the tape receiving part.

In the tape printing apparatus constructed above, since the lever can be operated to move the blade from the holding position to the cutting position when the cassette cover is set to cover the tape receiving part, a tape printed by the printing means can be cut out with the blade moved to the cutting position.

On the other hand, since the lever is restricted operating while the cassette cover is removed to open the tape receiving part, the blade can not be moved from the holding position to the cutting position. Accordingly, the blade is not moved from the holding position even if the lever is operated by accident while the cassette cover is removed, so that there is no danger of damaging an user by the blade when the cassette cover is taken off from the tape printing apparatus.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention. In the drawings.

DETAILED DESCRIPTION OF THE PREFERRED EMBODIMENTS

A detailed description of a preferred embodiment of a tape printing apparatus embodying the present invention will now be given referring to the accompanying drawings.

The tape printing apparatus in the embodiment according to the present invention is an improvement on the platen holder 8 of the tape printing apparatus 1 described in the above prior art section. This tape printing apparatus has substantially the same construction as the apparatus 1 mentioned above, accordingly, and the detailed description thereof is omitted in the embodiment. It is also noted that the same codes are given to the same components as those in the prior art section.

Figure 3:
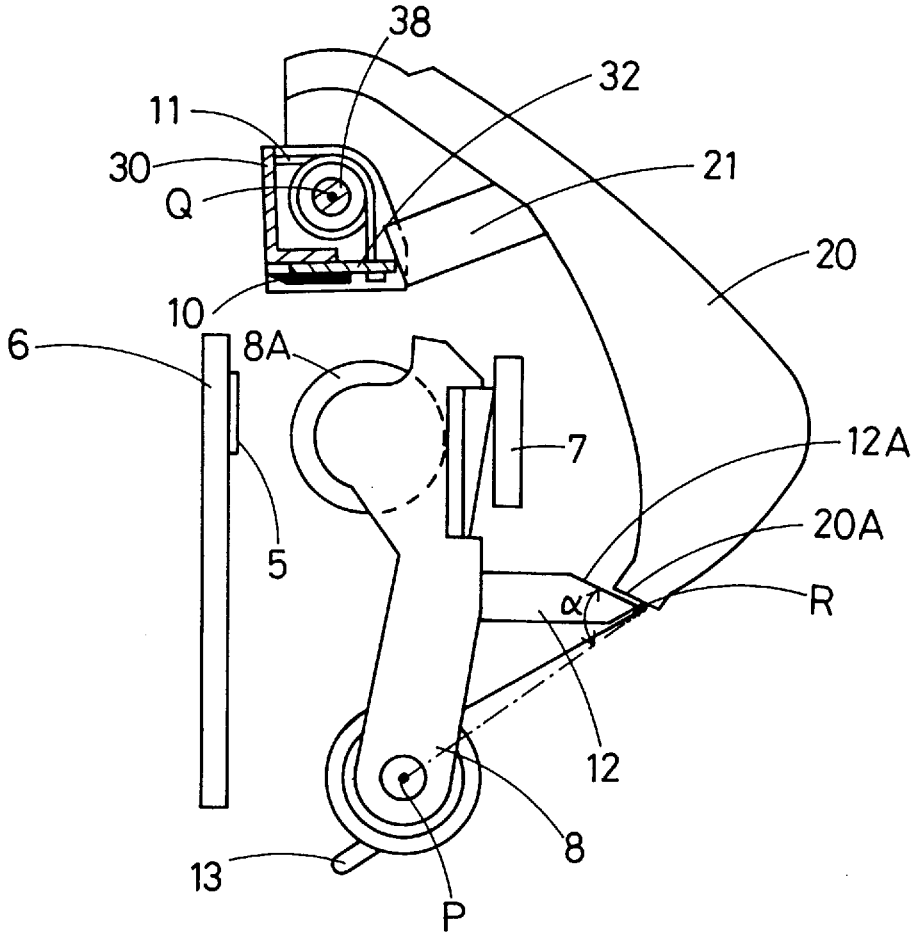
FIG. 3 is a schematic view of the tape receiving part and around it in the tape printing apparatus.
Figure 4:
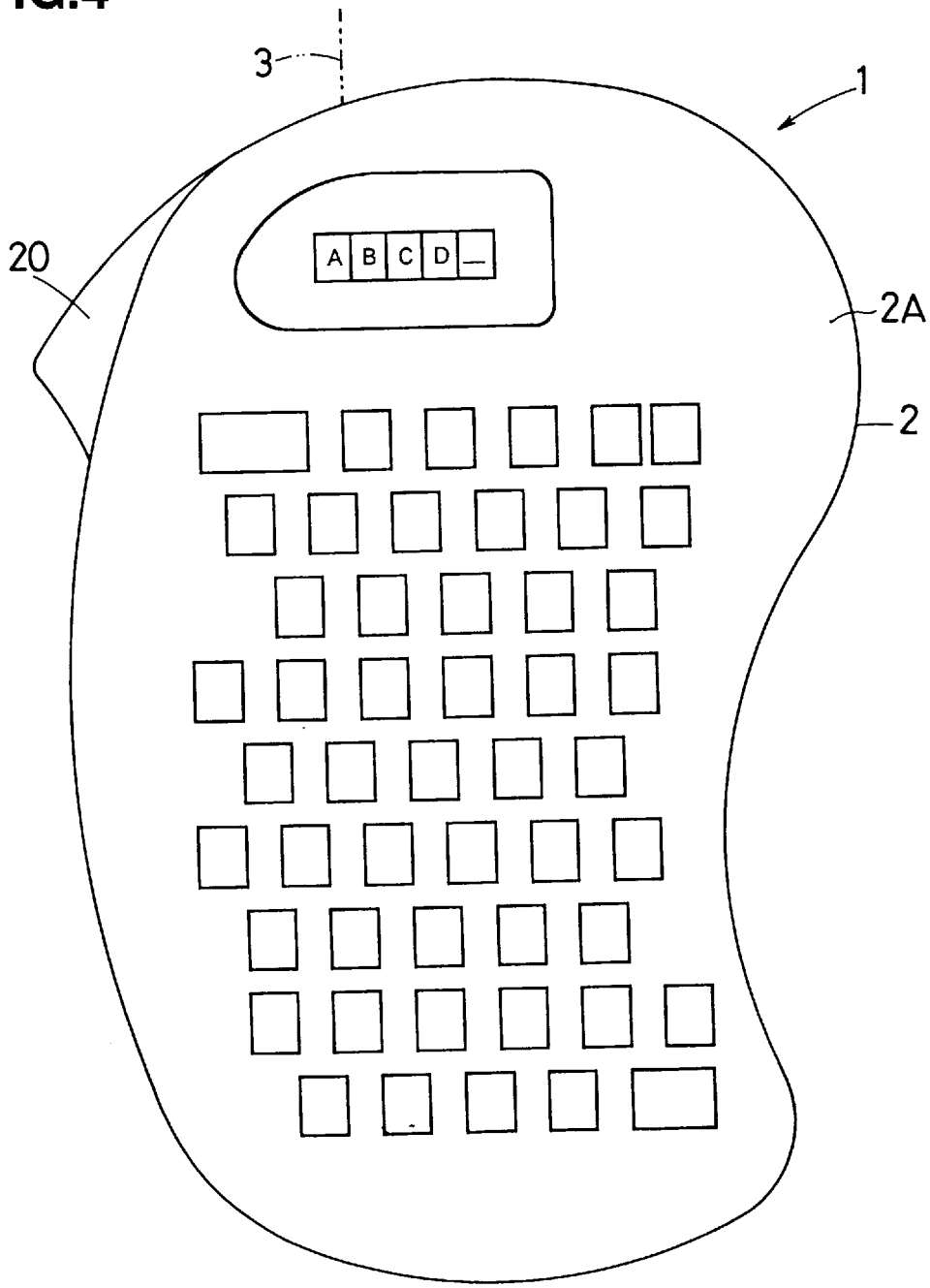
FIG. 4 is a plane view of the tape printing apparatus.
Figure 5:
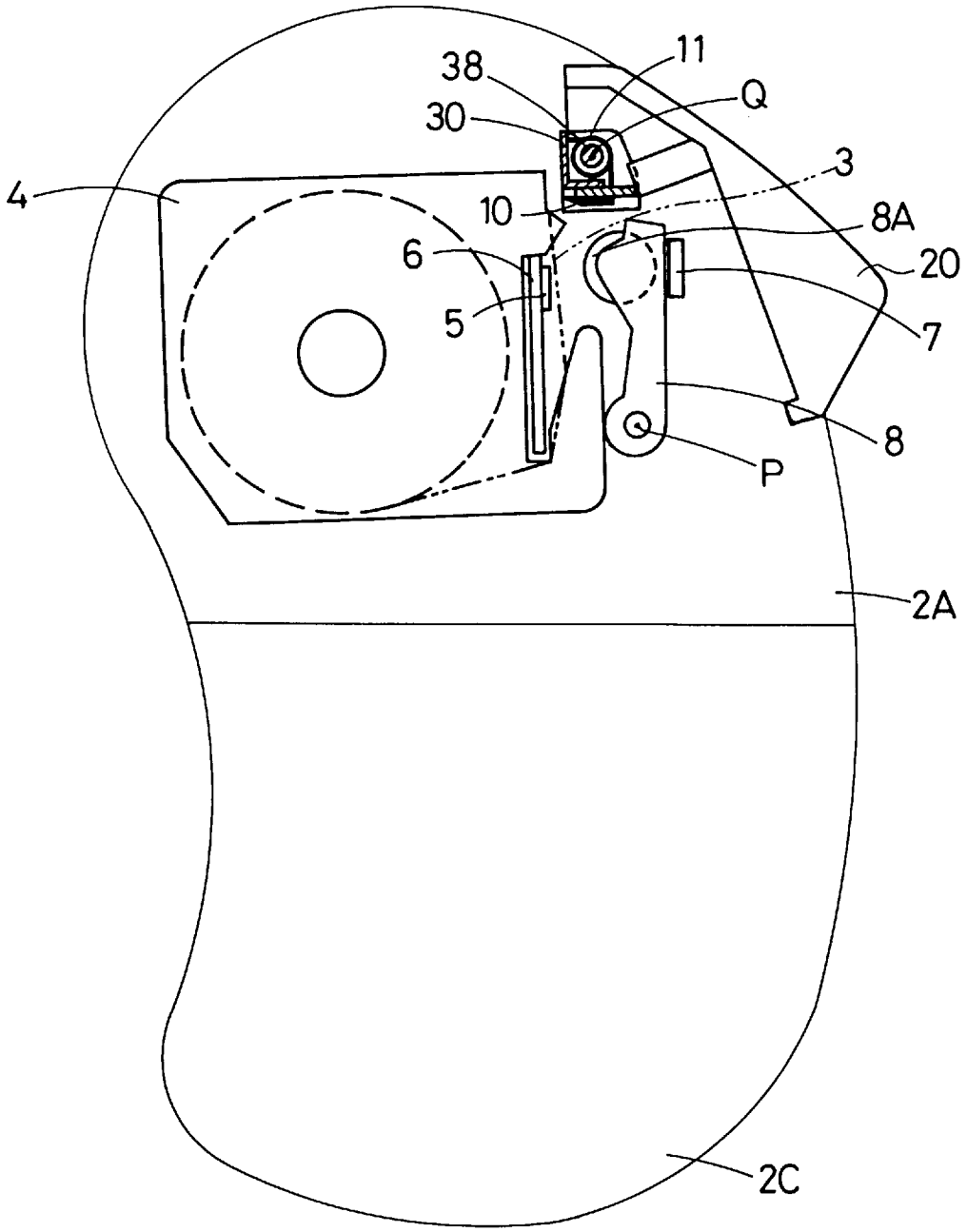
FIG. 5 is a schematic view of the inside of the tape printing apparatus viewed from below, specifically, the tape receiving part and around it.
Figure 6:
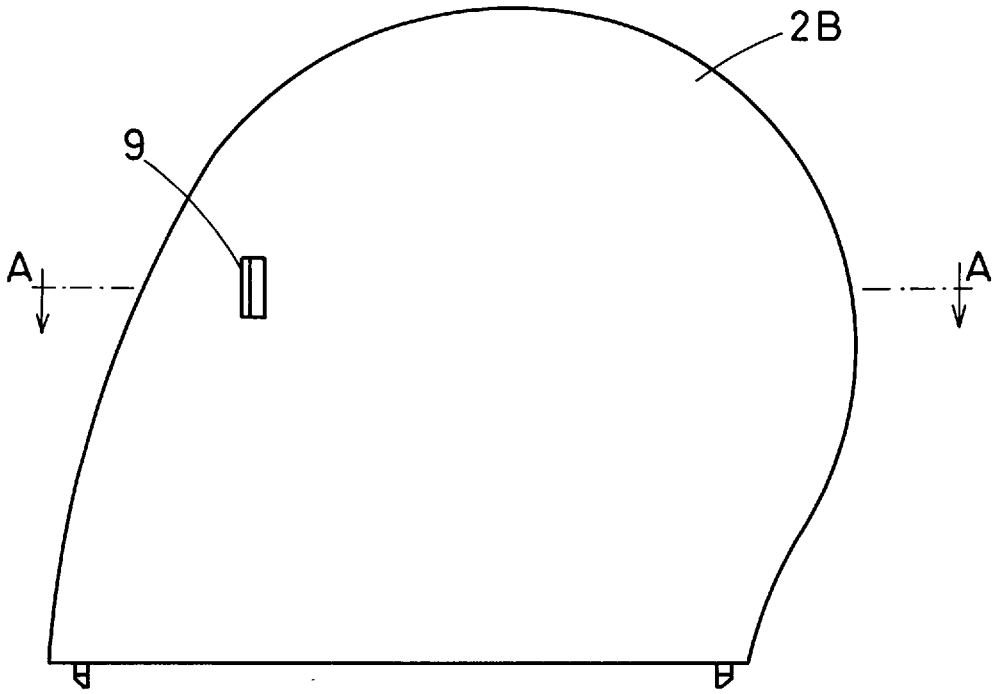
FIG. 6 is a schematic view of the inside of the cassette cover of the tape printing apparatus.
Figure 7:
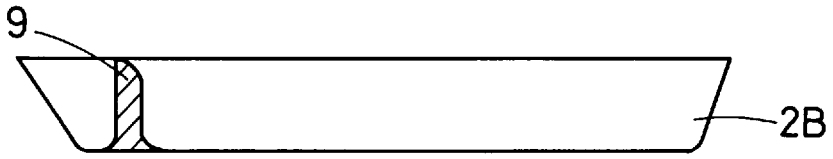
FIG. 7 is a sectional view of the cassette cover viewed along an A—A line of FIG. 6.

A platen holder 8 serving as a platen mechanism or an actuating member of the invention is provided with a stopper member 12 as shown in FIG. 3. This stopper member 12 has a contact plane 12A. This contact plane 12A of the stopper member 12 can come into contact with an engaging plane 20A of the lever 20 being pressed downward, while a cassette cover 2B is removed from an upper cover 2A, allowing the platen holder 8 to rotate to the home position shown in FIG. 3.

By coming into contact with the stopper member 12, the lever 20 is prevented from rotating about a rotating center Q toward the platen holder 8, i.e., in a clockwise direction in FIG. 3. At this time, a pressing member 21 of the lever 20 does not press a holding plate 32, so that a blade 10 mounted on the holding plate 32 can not be protruded out of a holding member 30. Since the holding plate 32 is, furthermore, always pressed backward in the holding member 30 (rightward in the FIG. 3) by a biasing force of a return spring 11, the blade 10 can be held in the inside of the holding member 30 in the state shown in FIG. 3 regardless of whether the lever 20 is depressed or not. The apparatus can thus be set in a lock mode.

The stopper member 12 is designed to have the contact plane 12A so that an angle a between this contact plane 12A and an imaginary straight line PR connecting a tip end R of the plane 12A and the fixed point P is set less than 90°. In the state shown in FIG. 3, when the lever 20 is depressed and comes into contact with the stopper member 12, the force exerted from the lever 20 onto the platen holder 8 acts so as to rotate the platen holder 8 about the fixed point P toward a position fixing member 7, i.e., in a clockwise direction in FIG. 3. Accordingly, the platen holder 8 does not rotate to move from the home position to the operational position even if the lever 20 is depressed.

It is noted that the above angle α may be set less than 95° according to material, friction coefficient, dimensional error and the like of the stopper member 12 and the lever 20. Furthermore, this angle α may be set to the angle so that the platen holder 8 can not be rotated even if the lever 20 being in contact with the stopper member 12 is depressed.

Figure 2:
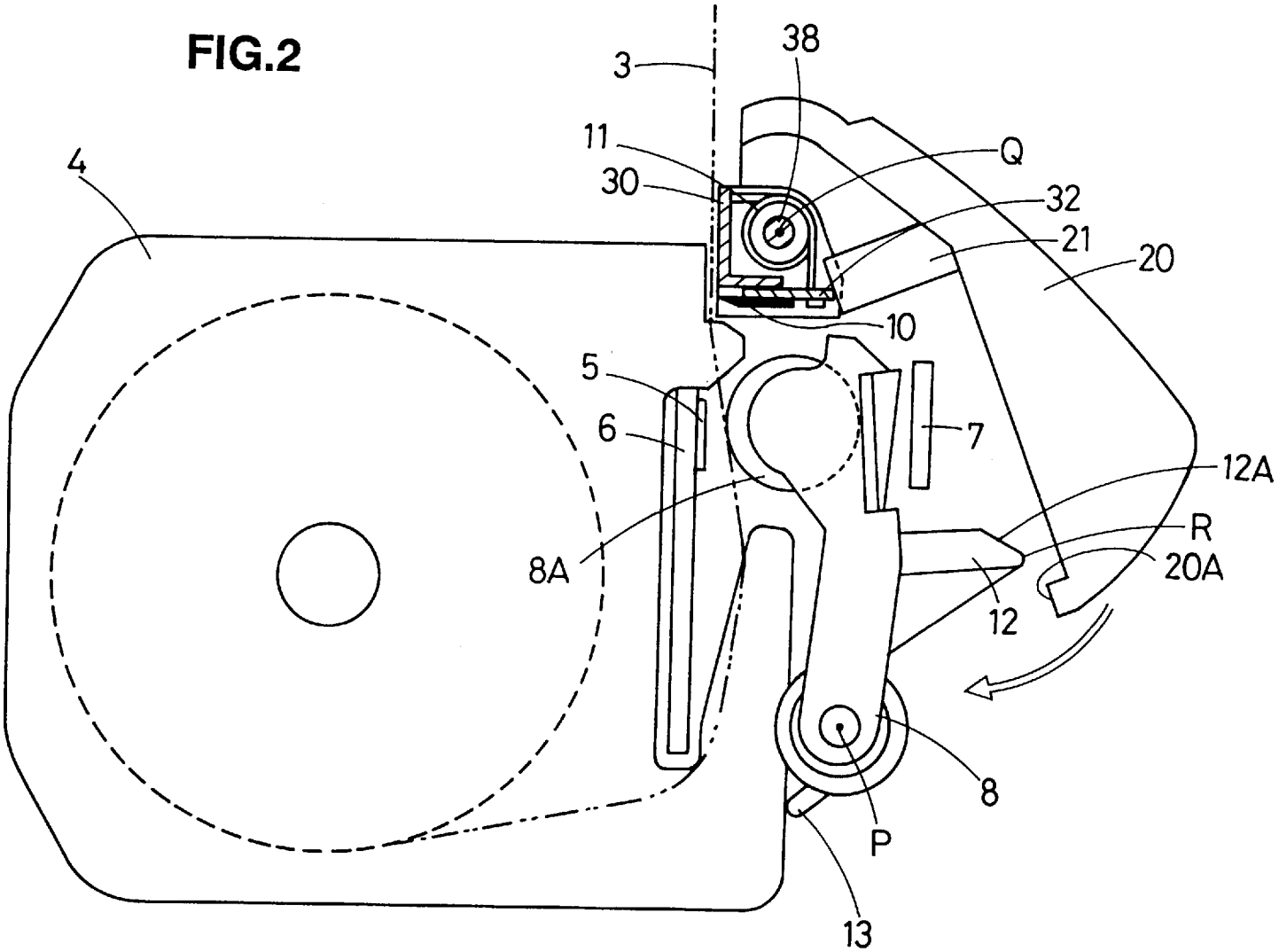
FIG. 2 is a schematic view of the tape receiving part and around it when the tape cassette is set in the tape receiving part while the cassette cover is removed from the tape printing apparatus in the embodiment.
Figure 8:
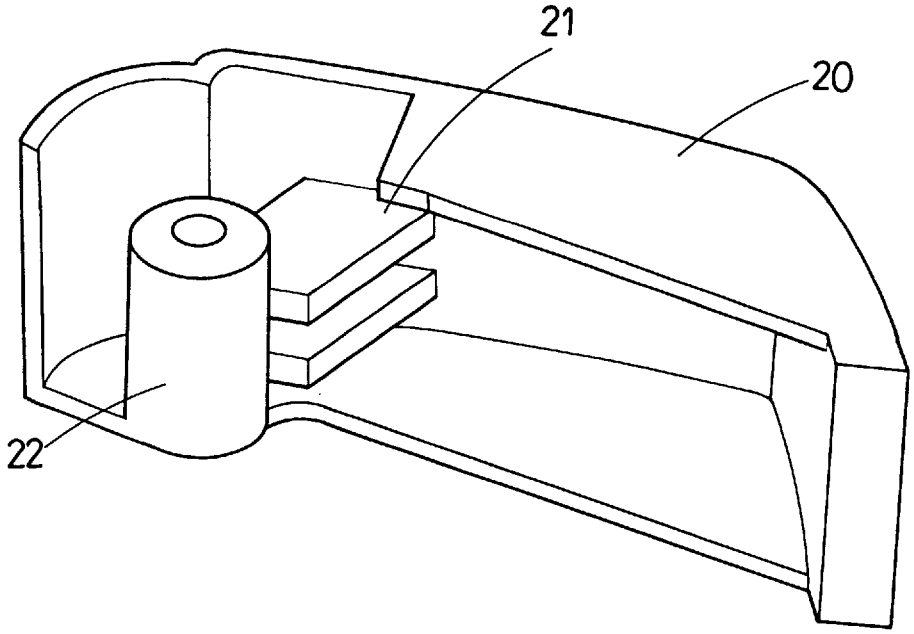
FIG. 8 is a perspective view of the lever of the tape printing apparatus.
Figure 9:
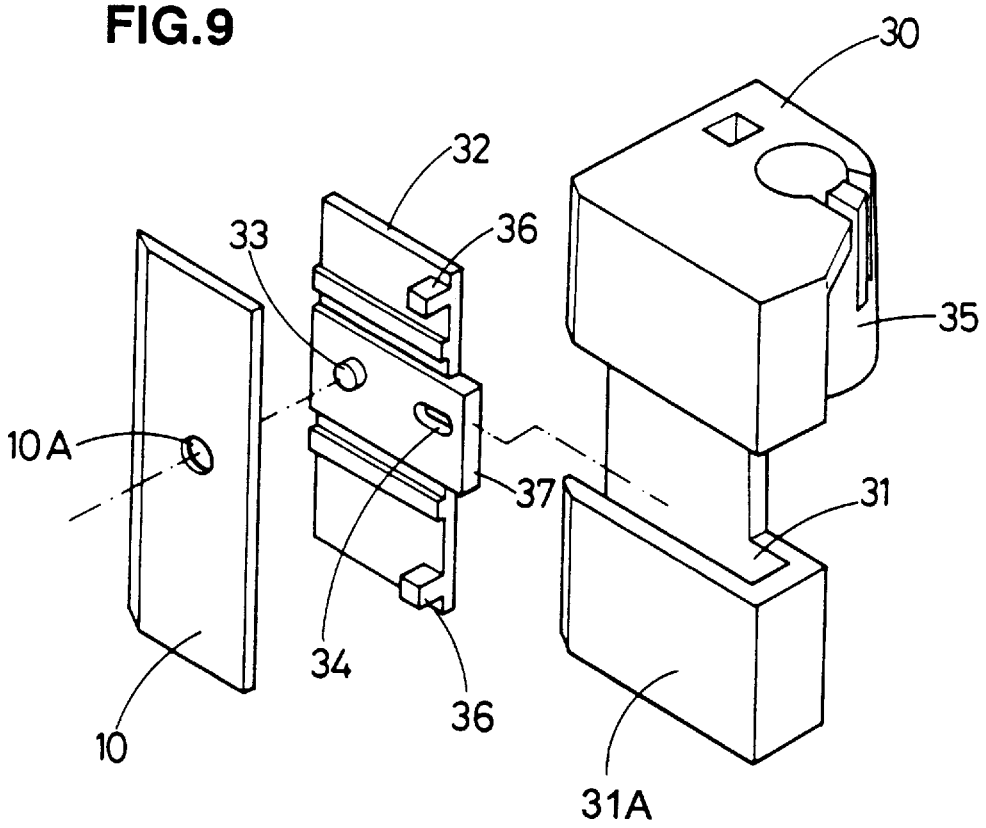
FIG. 9 is an exploded perspective view of a holding member of the tape printing apparatus.
Figure 10:
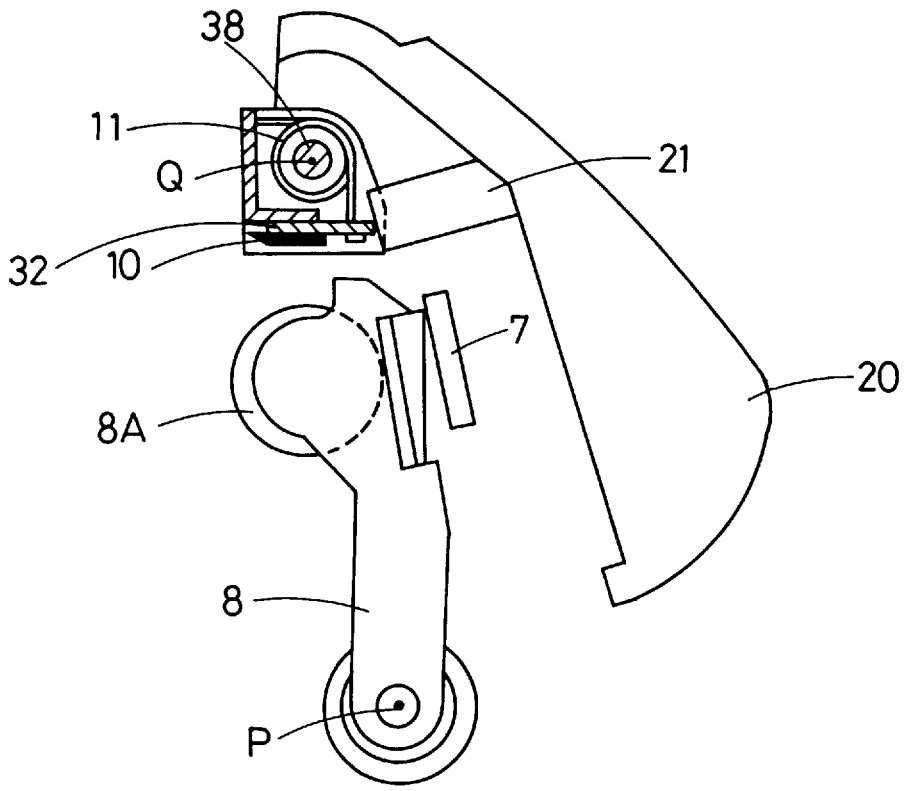
FIG. 10 is a schematic view of a tape receiving part in a conventional tape printing apparatus, when no tape cassette is set therein and a cassette cover is removed.
Figure 11:
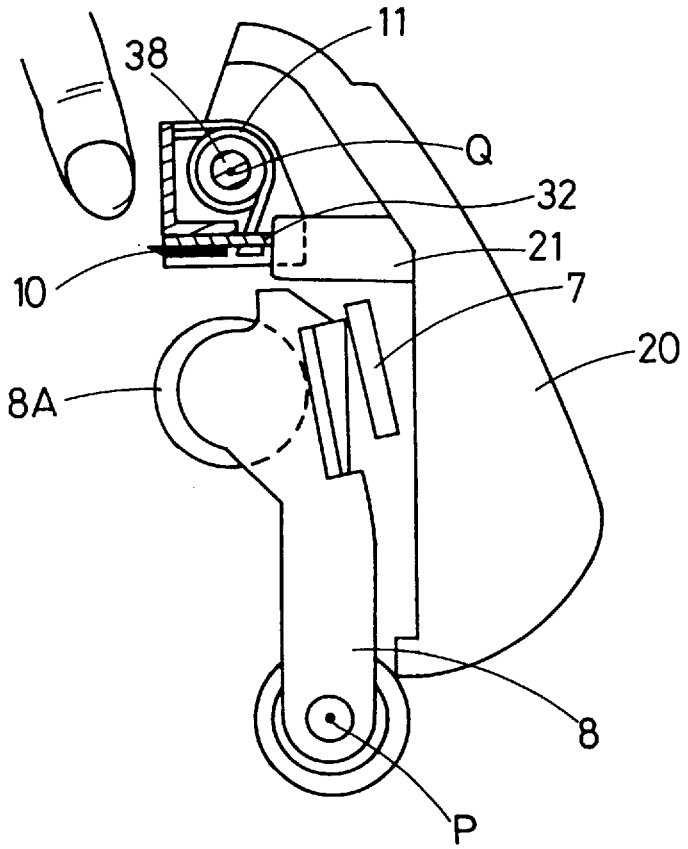
FIG. 11 is a schematic view of the tape receiving part and around it in the tape printing apparatus of FIG. 10, when a lever is depressed.

The platen holder 8 is also provided with a projection 13. When the tape cassette 4 is inserted in the tape receiving part, the projection part 13 is pressed by the tape cassette 4 to slightly rotate the platen holder 8 about the fixed point P toward the tape cassette 4 from the home position shown in FIG. 3, that is, toward the operational position in a counterclockwise direction in FIG. 2. Simultaneously, the stopper member 12 of the platen holder 8 moves into the empty inside (see FIG. 8) of the lever 20, where the stopper member 12 does not come into contact with the plane 20A of the lever 20. The lock mode is thus released. In the state of FIG. 2, accordingly, the tape 3 fed from the tape cassette 4 by the rotation of the platen roller 8A of the platen holder 8 can be cut out by the blade 10 which is protruded out of the holding member 30 by the depressing of the lever 20.

Figure 1:
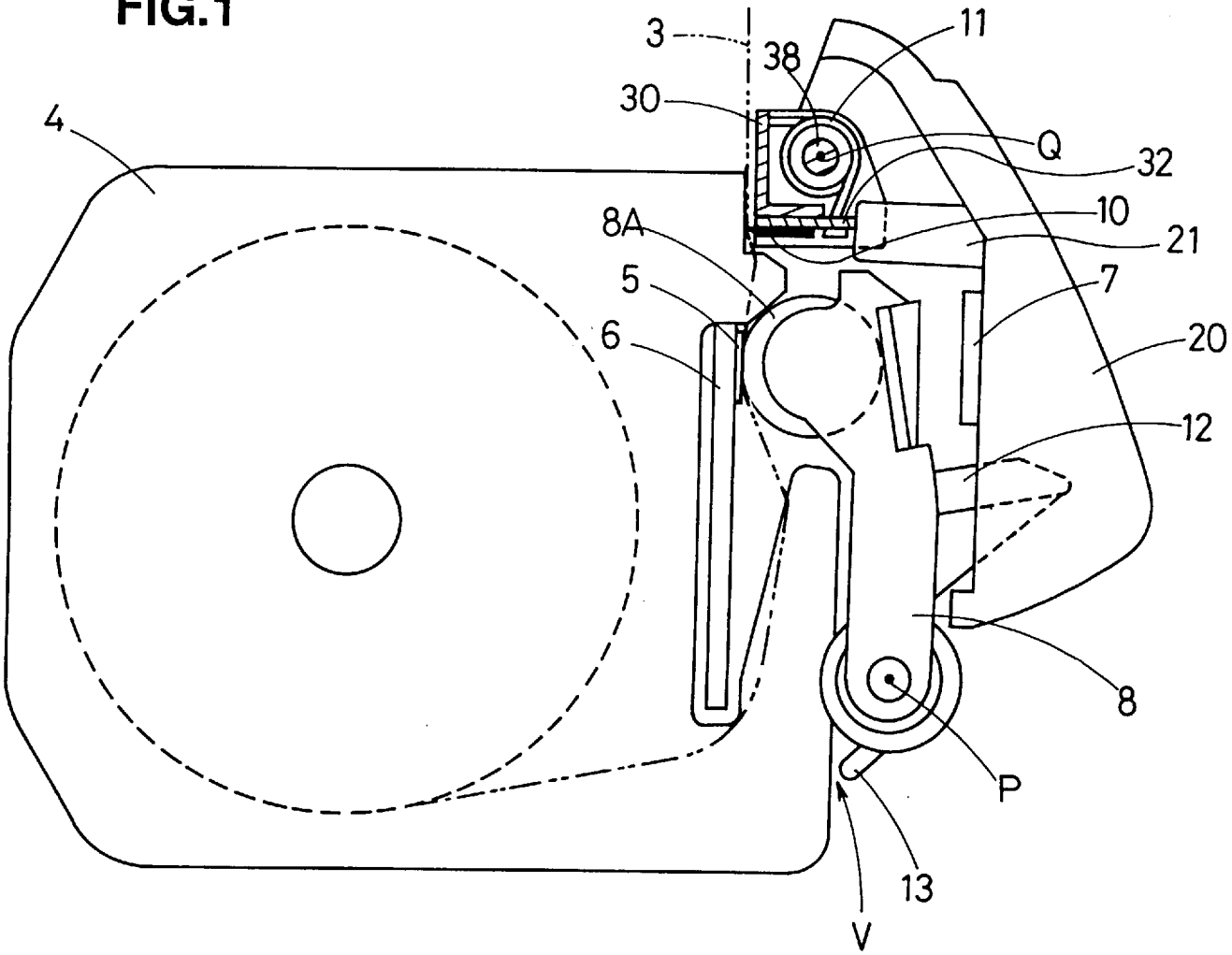
FIG. 1 is a schematic view of a tape receiving part and around it when a tape cassette is set in the tape receiving part and a cassette cover is attached in a tape printing apparatus in an embodiment according to the invention.

After the tape cassette 4 is inserted in the tape receiving part as shown in FIG. 1, the cassette cover 2B is attached to the upper cover 2A, thereby rotating the platen holder 8 to the operational position, when the stopper member 12 of the platen holder 8 moves to the inside of the lever 20. The stopper member 12 does not come into contact with the plane 20A even if the lever 20 is depressed. Thus, the lock mode is released. In the state of FIG. 1, accordingly, the tape 3 fed from the tape cassette 4 by the rotation of the platen roller 8A of the platen 8 can be cut out by the blade 10 protruded out of the holding member 30 by the depressing of the lever 20.

In the state of FIG. 1, furthermore, a clearance V is produced between the projection part 13 of the platen holder 8 and the tape cassette 4. At this time, the platen roller 8A being in the operational position is pressed against the thermal head 5 thereby to press a part of the tape 3 and a reaction force acts on the platen holder 8. However, the reaction force is not transmitted to the tape cassette 4 due to the clearance V produced between the platen holder 8 and the tape cassette 4.

As described above, when the platen holder 8 is rotated to the operational position (see FIG. 1) by the attaching of the cassette cover 2B to the upper cover 2A, the blade 10 can be protruded out of the holding member 30 according to the depressing of the lever 20, to cut the tape fed by the platen roller 8A.

On the other hand, when the platen holder 8 is rotated to the home position by the removing of the cassette cover 2B (see FIG. 3), no tape cassette being inserted in the tape receiving part, the lever 20 comes into contact with the stopper member 12 of the platen holder 8 and can not be depressed to protrude the blade 10 out of the holding member 30. In addition, the blade 10, being biased backward in the holding member 30 by the return spring 11, can be held in the holding member 30.

In other words, the apparatus can be set in the lock mode by the removing of the cassette cover 2B in case of no tape cassette being inserted. In this lock mode, the blade 10 can not be protruded out of the holding member 30 even if the lever 20 is depressed by accident, causing no danger by the blade 10 to an user who touches the holding member 30. According to the invention, the lock mode can be set by the removing of the cassette cover 2B if only the stopper member 12 is provided to the existing platen holder 8, making it possible to prevent the danger by the blade 10 being to be moved by the operation the lever 20 without providing additional space and increasing the number of parts.

When the cassette cover 2B is removed, the platen holder 8 is made to rotate about the fixed point P from the operational position to the home position. When the lever 20 is then depressed, rotating about the rotating center Q, as the platen holder 8 being in the home position, the lever 20 comes into contact with the contact plane 12A of the stopper member 12 of the platen holder 8. The stopper member 12 is formed to have the contact plane 12A so that the angle a between the contact plane 12A and the imaginary line PR connecting the tip end R of the stopper member 12 and the fixed point P is set to approximately 90° or less than 90°. The force of the lever 20 acts on the contact plane 12A of the stopper member 12 so as to always bias the platen holder 8 toward the home position, whereby the platen holder 8 can not be rotated toward the operational position. Accordingly, the lock mode set by the removing of the cassette cover 2B is not released even if the lever 20 is depressed.

Consequently, when the platen holder 8 is moved to the home position due to the removing of the cassette cover 2B, the blade 10 can not be protruded out of the holding member 30 even if the lever 20 is depressed by accident, which can prevent the danger of damaging an user by the blade 10 when the user touches the holding member 30 after the cassette cover 2B is removed.

If only the stopper member 12 having the contact plane 12A formed as above is provided to the existing platen holder 8, the apparatus can be set in the lock mode by the removing of the cassette cover 2B. This makes it possible to prevent the danger by the blade 10 interlocking with the lever 20, without providing additional space and increasing the number of parts.

When the tape cassette 4 is inserted in the tape receiving part in the upper cover 2A while the platen holder 8 is in the home position by the removing of the cassette cover 2B, the tape cassette 4 presses the projection part 13 of the platen holder 8 being in the home position to move the platen holder 8 from the home position to the operational position (see FIG. 2). As a result, the lever 20 does not come into contact with the stopper member 12 and the blade 10 can be protruded out of the holding member 30 when the lever 20 is depressed, to cut out the tape 3 fed out of the tape cassette 4.

As mentioned above, even if the apparatus is set in the lock mode due to the removing of the cassette cover 2B, the lock mode can be released when the tape cassette 4 is inserted in the tape receiving part in the upper cover 2A. In this case that the lock mode is released as above, the tape cassette 4 being inserted in the tape receiving part, the user can not touch the holding member 30, thus causing no danger of damaging the user by the blade 10.

In other words, even when the cassette cover 2B is removed, the blade 10 can be protruded out of the holding member 30 by the depressing of the lever 20 if the tape cassette 4 is inserted in the tape receiving part of the upper cover 2A. If only the projection part 13 is provided to the existing platen holder 8, the lock mode set by the removing of the cassette cover 2B can be released by the insertion of the tape cassette 4 into the tape receiving part in the upper cover 2A, which prevents the increase in the number of parts and the provision of the additional space.

When the cassette cover 2B is attached thereby to make the platen holder 8 rotate to the operational position, the clearance V is produced between the tape cassette 4 inserted in the tape receiving part and the projection part 13 of the platen holder 8, so that the reaction force which the platen holder 8 being in the operational position receives in feeding the tape is not transmitted to the tape cassette 4 through the projection part 13, making it possible to protect the tape cassette 4.

Such the clearance V can easily be produced by the attachment of the cassette cover 2B after the platen holder 8 is slightly moved from the home position to the operational position by means of the projection part 13. Consequently, there is no necessary to fully rotate the platen holder 8 from the home position to the operational position with the tape cassette 4, not requiring so much the strength to push the tape cassette 4 into the tape receiving part in the upper cover 2A.

While the tape cassette 4 is inserted in the tape receiving part of the upper cover 2A, the lever 20 can be operated, whereby the blade 10 can be moved from the home position to the cutting position. The tape printed by the thermal head 5 is thus cut out. When the tape cassette 4 is removed from the tape receiving part, the lever 20 is restricted to operate, which prevents the blade 10 from moving from the holding position to the cutting position.

The blade 10, accordingly, can not be moved from the holding position to the cutting position even if the lever 20 is operated by accident when the tape cassette 4 is not in the tape receiving part, so that there is no danger of damaging the user by the blade 10 when the tape cassette 4 is removed from the tape receiving part of the upper cover 2A. The blade 10 can be held at the holding position in the holding member with its tip end not being in contact with the holding member, thereby causing no damage on the tip end of the blade 10. This can prevent the cutting power of the blade 10 from being weakened and the life of the same from being shortened.

The present invention may be embodied in other specific forms without departing from the spirit or essential characteristics thereof. For instance, although the cassette cover 2B of the tape printing apparatus 1 in the above embodiment is formed so as to be attached or removed to/from the upper cover 2A, it may be constructed so as to be rotatably supported by the upper cover 2A, thereby opening and closing with respect to the upper cover 2A, if only the platen holder 8 can be moved between the operational position and the home position by interlocking to the cassette cover 2B.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A tape printing apparatus comprising:

a main body having a tape receiving part;

a cover member for opening and closing the tape receiving part;

a tape cassette having a print tape therein, the tape cassette being set in the tape receiving part;

a platen mechanism movable between an operational position and a home position according to a closing and opening operation of the cover member, the platen mechanism feeding the tape from the tape cassette;

a print head for printing on the print tape fed by the platen mechanism;

a blade for cutting the print tape after printed by the print head;

a holding member for covering the blade slidably therein between a cutting position and a holding position;

a resilient member for biasing the blade toward the holding position;

a lever for pressing the blade toward the cutting position; and a stopper member formed on the platen mechanism, which comes into contact with the lever when the platen mechanism is in the home position according to opening of the cover member and sets a lock mode that the blade is held in the holding position.

2. The tape printing apparatus according to claim 1, further comprising a position fixing member formed near the tape receiving part, wherein the platen mechanism is rotatable about a fixed point and is biased toward the position fixing member.

3. The tape printing apparatus according to claim 2, wherein the platen mechanism comes into contact to the position fixing member when the cover member is opened.

4. The tape printing apparatus according to claim 3, wherein the stopper member has a contact plane to come into contact with the lever.

5. The tape printing apparatus according to claim 4, wherein a pressing force produced when the lever is pressed under the lock mode acts to rotate the platen mechanism toward the position fixing member.

6. The tape printing apparatus according to claim 5, wherein an angle defined between the contact plane of the stopper member and an imaginary line connecting a tip end of the stopper member and the fixed point is set to approximately 90° or less than 90°.

7. The tape printing apparatus according to claim 1, further comprising a projection part formed on the platen mechanism, the projection part being pressed by the tape cassette set in the tape receiving part and moving slightly the platen mechanism toward the operational position from the home position.

8. The tape printing apparatus according to claim 7, wherein the stopper member is moved along with slight movement of the platen mechanism and the lock mode is released.

9. The tape printing apparatus according to claim 8, wherein further movement of the platen mechanism caused by the closing operation of the cassette cover produces a clearance between the projection part of the platen mechanism and the tape cassette.

10. A tape printing apparatus comprising:

a main body having a tape receiving part;

a tape cassette removably inserted in the tape receiving part, the tape cassette holding a tape therein;

a printing means for performing a print operation on the tape fed out of the tape cassette;

a blade for cutting the tape printed by the printing means, the blade being movable between a cutting position and a holding position apart from the tape;

a lever to be operated for moving the blade from the holding position to the cutting position; and a stopper member for preventing the lever from being operated to move the blade from the holding position to the cutting position when the tape cassette is removed from the tape receiving part and, alternatively, for allowing the lever to be operated when the tape cassette is inserted in the tape receiving part.

11. The tape printing apparatus according to claim 10, further comprising a cassette cover for covering the tape receiving part, the cassette cover being removably attached to the tape receiving part.

12. The tape printing apparatus according to claim 11, further comprising an actuating member on which the stopper member is formed, wherein the actuating member restricts the lever to be operated through the stopper member when the cassette cover is removed from the tape receiving part and allows the lever to be operated when the cassette cover is set to the tape receiving part.

13. A tape printing apparatus comprising:

a main body having a tape receiving part;

a tape cassette removably inserted in the tape receiving part, the tape cassette holding a tape therein;

a cassette cover for covering the tape receiving part, removably attached to the tape receiving part;

a printing means for performing a print operation on the tape fed out of the tape cassette;

a blade for cutting the tape printed by the printing means, the blade being movable between a cutting position and a holding position apart from the tape;

a lever to be operated for moving the blade from the holding position to the cutting position; and a stopper member for preventing the lever from being operated to move the blade from the holding position to the cutting position when the cassette cover is removed from the tape receiving part and, alternatively, for allowing the lever to be operated when the cassette cover is set to the tape receiving part.

* * * * *